US009254054B1

(12) United States Patent
Nesper

(10) Patent No.: US 9,254,054 B1
(45) Date of Patent: Feb. 9, 2016

(54) GARMENT DUST PROTECTOR

(71) Applicant: Matthew James Nesper, Sonora, CA (US)

(72) Inventor: Matthew James Nesper, Sonora, CA (US)

( * ) Notice: Subject to any disclaimer, the term of this patent is extended or adjusted under 35 U.S.C. 154(b) by 0 days.

(21) Appl. No.: 14/287,195

(22) Filed: May 27, 2014

Related U.S. Application Data

(60) Provisional application No. 61/958,732, filed on Aug. 5, 2013, provisional application No. 61/855,797, filed on May 24, 2013.

(51) Int. Cl.

| | |
|---|---|
| ***A47G 25/06*** | (2006.01) |
| ***A47G 25/54*** | (2006.01) |
| *B65D 85/18* | (2006.01) |

(52) U.S. Cl.

CPC ..... *A47G 25/54* (2013.01); *A47G 25/06* (2013.01); *A47G 25/0664* (2013.01); *B65D 85/18* (2013.01)

(58) Field of Classification Search

CPC ... A47G 25/00; A47G 25/06; A47G 25/0664; A47G 25/0692; A47G 25/54; A45C 13/002; A47H 13/01; G11B 33/02; B65D 85/18

USPC ..... 223/52; 211/85.3, 123, 119.19

See application file for complete search history.

(56) References Cited

U.S. PATENT DOCUMENTS

| | | | | |
|---|---|---|---|---|
| 942,580 | A * | 12/1909 | McGregor et al. | 312/3 |
| 1,454,334 | A * | 5/1923 | Parker | 206/285 |
| 1,464,904 | A * | 8/1923 | Feldman | 211/180 |
| 1,571,366 | A * | 2/1926 | Bender | 312/6 |
| 1,977,167 | A * | 10/1934 | Bloom | 211/180 |
| 2,351,882 | A | 6/1944 | Schwartman | |
| 2,899,081 | A | 8/1959 | Meyers | |
| 4,140,163 | A | 2/1979 | Usner | |
| 4,236,634 | A | 12/1980 | Benedict | |
| 5,071,003 | A | 12/1991 | Freelander | |
| 5,564,577 | A * | 10/1996 | Knaggs | 211/86.01 |
| 5,697,508 | A | 12/1997 | Rifkin et al. | |
| 7,600,636 | B2 | 10/2009 | Bell | |
| 2007/0193970 | A1 | 8/2007 | Carington et al. | |

* cited by examiner

*Primary Examiner* — Ismael Izaguirre

(74) *Attorney, Agent, or Firm* — Patent Law Offices of Michael E. Woods; Michael E. Woods

(57) ABSTRACT

A garment protection system operational with a horizontally disposed clothes rod, including a pair of stands, each stand including an arched surface portion coupled to a notch portion, the arched surface portion having a curve profile and the notch portion including a pair wall segments joined together defining an angle with the curve profile substantially symmetric about an axis bisecting the angle; and a semi-rigid panel configured to both substantially match the curve profile along a panel length from a first end to a second end when a panel center portion is laterally supported by the arched surface portions at the ends and to non-drapingly support lateral edges of the panel to define a span from one lateral edge to an opposing lateral edge with the rod disposed in between the lateral edges.

4 Claims, 5 Drawing Sheets

GARMENT DUST PROTECTOR

CROSS REFERENCE TO RELATED APPLICATIONS

This application claims benefit of both U.S. patent application No. 61/855,797 and U.S. patent application No. 61/958,732, the contents of which are hereby expressly incorporated by reference in their entireties for all purposes.

FIELD OF THE INVENTION

The present invention relates generally to clothing protection, and more specifically, but not exclusively, to a garment dust protector shielding horizontal upward-facing surfaces of hanging clothing.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Unwanted debris (e.g., dust and the like) is known to collect on horizontal upward-facing surfaces of each garment hanging on a hanger stored in a closet or the like.

There are different solutions to this problem known in the art. Many solutions involve completely encasing one or more hangered garments in an enclosure. This enclosure often will include an opening that may be repeatably opened and closed, allowing a user to open the enclosure, access the storage volume (reviewing, adding, or removing garments as desired) and then close the enclosure. Some solutions further provide for an ability to vacuum seal the enclosure to further protect the garments.

Such solutions are inconvenient for a user, particularly for clothing included in a day-to-day wardrobe for the user. These solutions are avoided for "every day" use because of the inconvenience of accessing the storage volume, including the requirement that the user is often required to use both hands and the relatively significant time to access the storage volume as compared to an alternative of just hanging the garment from a horizontal rod in a closet. This alternative is a baseline by which solutions are measured: convenience in reviewing the hanging garment(s) and accessing a particular garment to either add or remove it from storage.

Other solutions may provide a longitudinal support spaced away from and parallel to the clothes rod (i.e., (directly above the rod along its length). A drape may be suspended from the longitudinal support to provide a tent or net. Without the support, the drape collapses.

What is needed is a system and method for reducing or eliminating debris accumulation on hangered clothing that improves on existing solutions.

BRIEF SUMMARY OF THE INVENTION

Disclosed is a system and method for reducing or eliminating debris accumulation on hangered clothing that improves on existing solutions.

The following summary of the invention is provided to facilitate an understanding of some of technical features related to garment protection within a closet, and is not intended to be a full description of the present invention. A full appreciation of the various aspects of the invention can be gained by taking the entire specification, claims, drawings, and abstract as a whole. The present invention is applicable to other environments needing to define a simple-to-access system and method for a protection volume below a horizontally disposed support rod.

Unwanted dust is known to collect on horizontal upward-facing surfaces such as the collar and shoulders of a garment hanging on a hanger. Embodiments of the present invention serve to reduce and/or prevent such dust accumulation on hangered clothing, while allowing easy access.

An embodiment includes one or more lightweight panels fixed to a closet rod on stands in such a way as to allow access to the clothing while serving as a dust protector. These panels are of lightweight, slightly flexible sheet material, such as plastic or metal. Each panel is identical to other panels and may include holes to allow a panel to be secured to the stands. Panels are secured to the stands, such as by fitting over posts in the stand in a friction fit. The stands are identical to each other. Each stand is designed to support the panels on its top surface while imparting a collapse-inhibiting curvature (e.g., a special arch-shape) to the supported panel, while standing atop the closet rod, fixed by connectors (e.g., elastomeric straps). The curvature and height of the stands is designed to impart the characteristic arch to each panel while allowing sufficient room to remove and replace hangers, especially a hanger loaded with a garment. The panels are removably secured to the stands by fitting over posts disposed on the top surface of the stand. The stands are removably fixed to an upper surface of the closet rod by the connectors.

In some implementations, a system consists of a single sheet of semi-flexible material mounted to a closet rod on stands in such a way as to allow access to the clothing while serving as a dust protector.

A garment protection system operational with a horizontally disposed clothes rod, including a pair of stands, each stand including an arched surface portion coupled to a notch portion, the arched surface portion having a curve profile and the notch portion including a pair wall segments joined together defining an angle with the curve profile substantially symmetric about an axis bisecting the angle; and a semi-rigid panel configured to both substantially match the curve profile along a panel length from a first end to a second end when a panel center portion is laterally supported by the arched surface portions at the ends and to non-drapingly support lateral edges of the panel to define a span from one lateral edge to an opposing lateral edge with the rod disposed in between the lateral edges.

A dust protection method for inhibiting dust accumulation below a clothes rod in a clothing closet, including (a) securing a pair of stands directly to a top of the clothes rod, each stand including an arched surface portion coupled to a notch portion, the arched surface portion having a curve profile and the notch portion including a pair wall segments joined together defining an angle with the curve profile substantially symmetric about an axis bisecting the angle with the notch portions engaging the clothes rod; and thereafter (b) fixing a semi-rigid panel on top of the arched surface portions, the semi-rigid panel configured to both substantially match the curve profile along a panel length from a first end to a second end when a panel center portion is laterally supported by the arched surface portions at the ends and to non-drapingly support lateral edges of the panel to define a span from one lateral edge to an opposing lateral edge with the rod disposed in between the lateral edges.

Some embodiments may provide each panel with a curvature at one or more lower free edges to further impart any necessary or desired rigidity to a supported and deployed panel.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Figure 1:
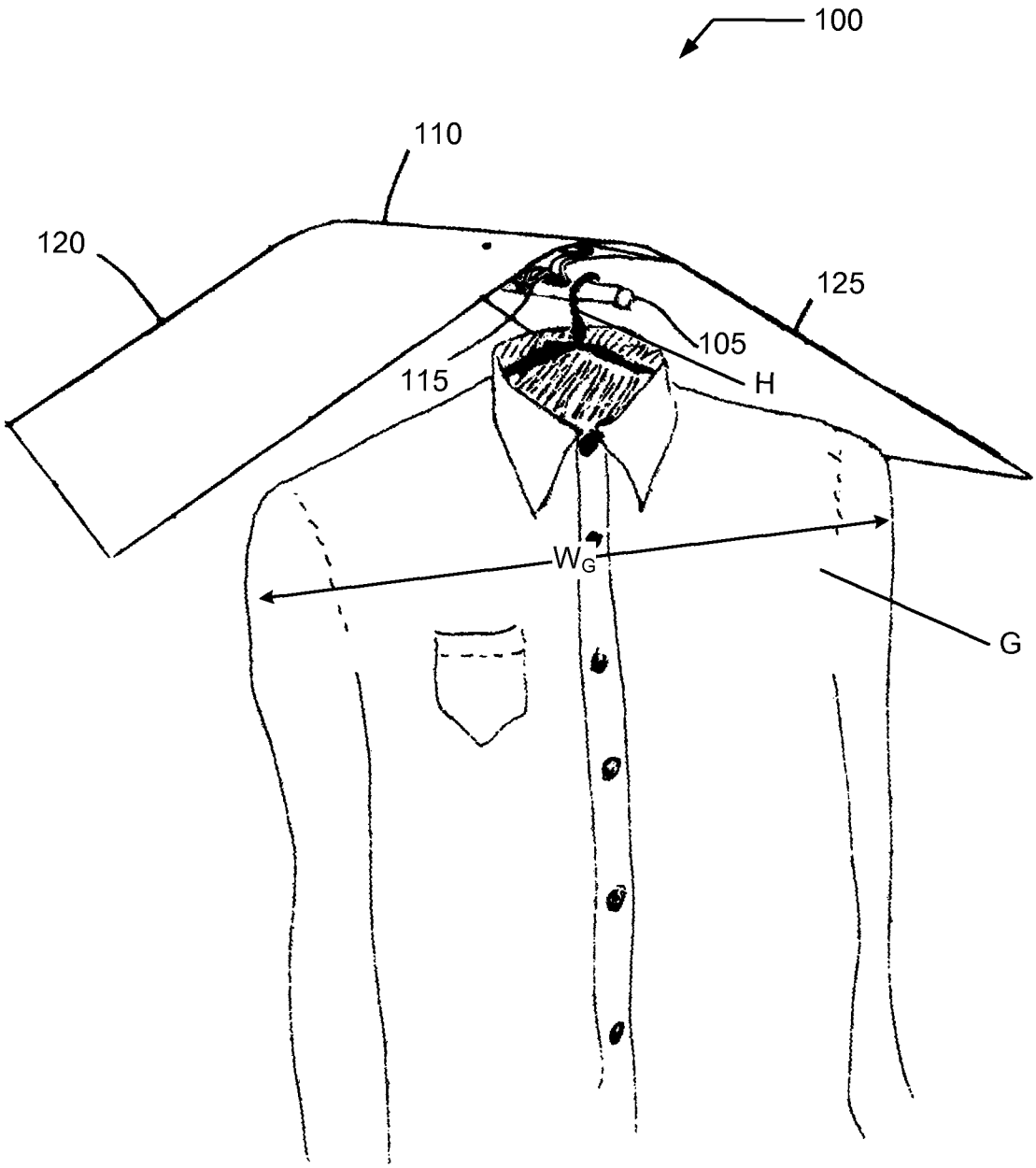
FIG. 1 illustrates a dust protection system.

Embodiments of the present invention provide a system and method for reducing or eliminating debris accumulation on hangered clothing that improves on existing solutions. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

DEFINITIONS

The following definitions apply to some of the aspects described with respect to some embodiments of the invention. These definitions may likewise be expanded upon herein.

As used herein, the term "or" is generally intended to mean "and/or" unless otherwise indicated.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

As used herein, the term "non-drapingly" refers to a characteristic of a semi-rigid/flexible protection panel that allows the panel to easily bent and moved while concurrently having enough rigidity to be supported without falling substantially straight down in which a shape or profile significantly follows a contour of the underlying garments. The non-drapingly material is fixed at the clothes rod using a stand and is sufficiently rigid that some moment and shear stress of unsupported portions of the panel are communicated to the stand. The material is able to independently define a protection span between lateral free edges of the panel that is wider than the protected contents without requiring contact with the contents or other support besides the central rod-affixed stand.

Figure 2:
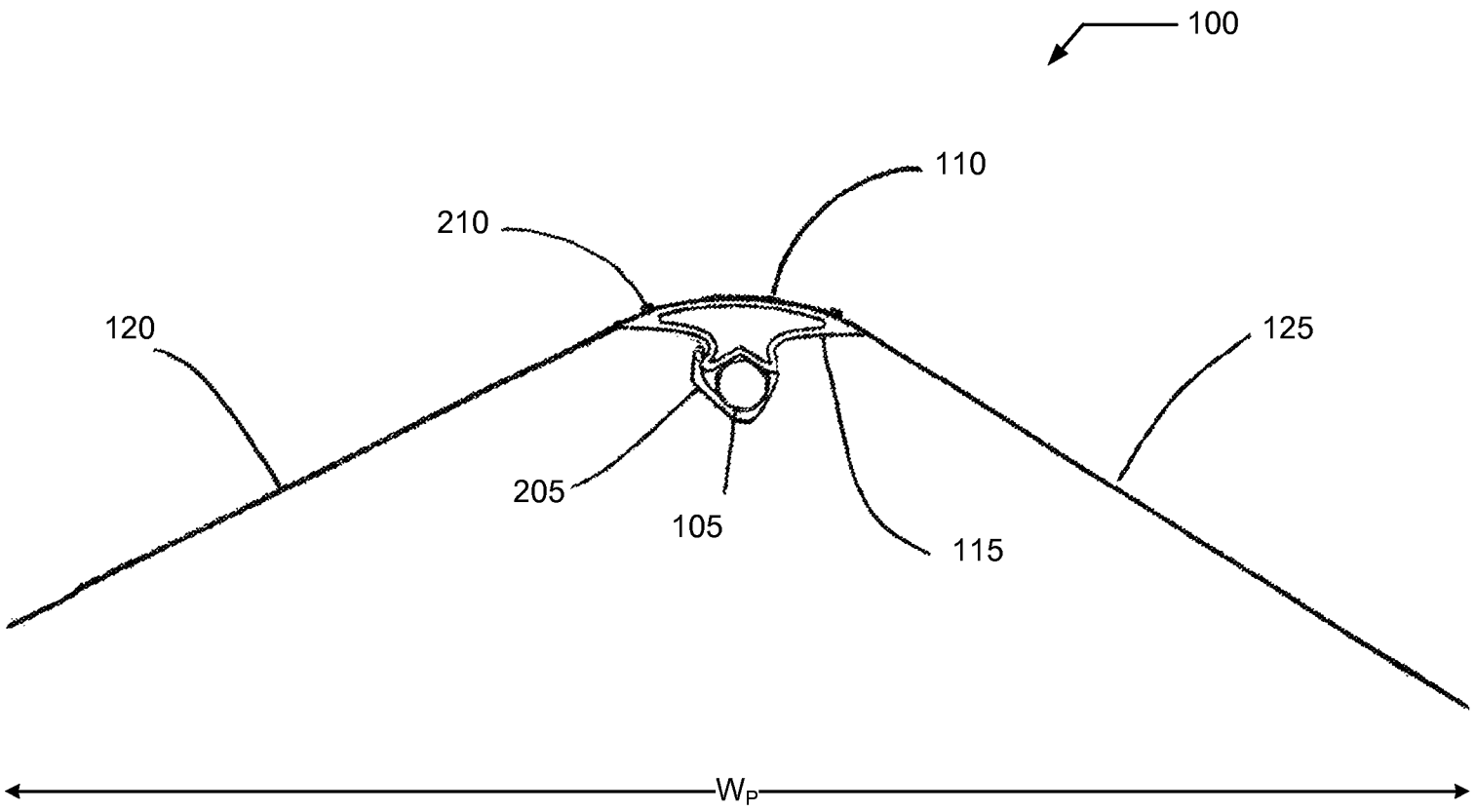
FIG. 2 illustrates an end-view of the dust protection system of FIG. 1.
Figure 3:
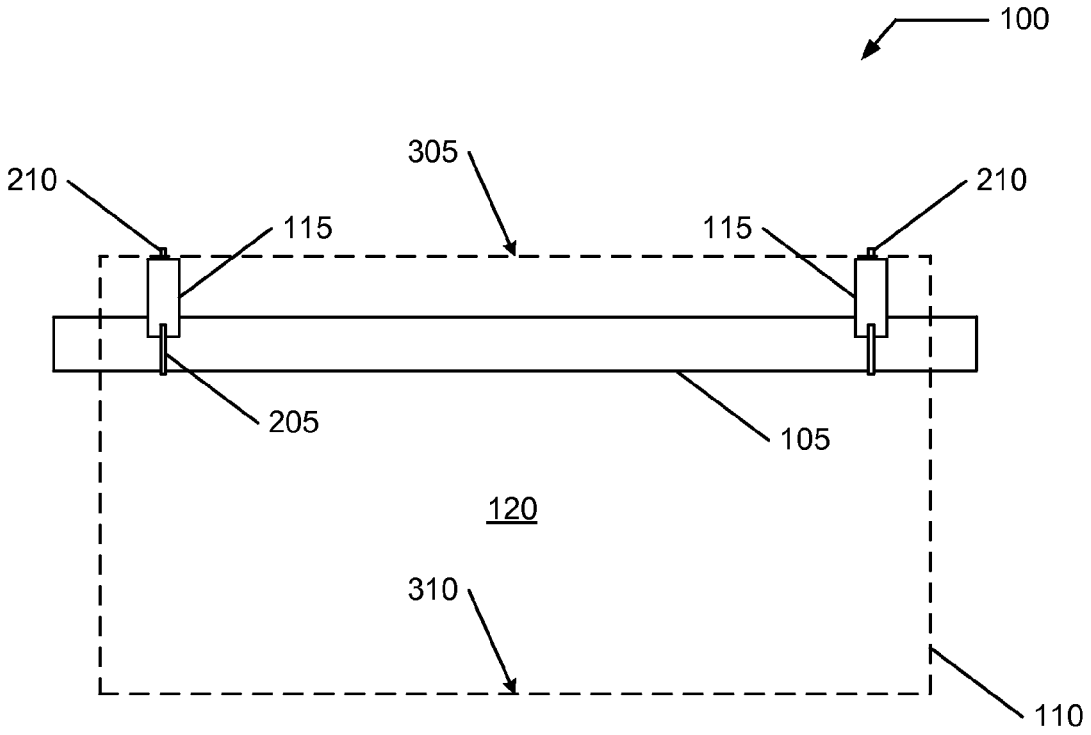
FIG. 3 illustrates a side view of the dust protection system of FIG. 1.

FIG. 1 illustrates a dust protection system 100; FIG. 2 illustrates an end-view of dust protection system 100; and FIG. 3 illustrates a side view of dust protection system 100. System 100 is configured to be compatible with a garment storage system (e.g., a closet having a clothes rod 105 horizontally disposed within the closet for supporting a plurality of garments G, each garment G suspended from rod 105 by a clothes hanger H). System 100 includes one or more panels 110 supported by a plurality of stands 115 secured to rod 105. In the illustrated embodiment, panel 110 is a single structure that is supported along a center length defining two half portions: a first shielding portion 120 and a second shielding portion 125. (Some implementations may include multiple discrete half panels overlapping along the center portion.) Rod 105 is often deployed horizontally within a closet, with rod 105 extending from a left hand side to a right hand side, rod 105 may be supported from its ends and/or intermedially along its length such as by a hanging strap or the like. In such an implementation, first portion 120 would be forward of second portion 125.

As further detailed in FIG. 2, stand 115 is secured to rod 105 by a connector 205. In one implementation, connector 205 is an elastic band (e.g., "O-ring") that connects to each pin of a set of pins on lower lateral portions of stand 115 after spanning a lower portion of rod 105. Connector 205 may be adjusted for differing diameters of rod 105 by appropriately adjusting a diameter of connector 205. Larger diameter rods 105 may require a larger diameter connector 205; further dependent upon a desired spring force that holds stand 115 in place relative to rod 105.

Helping to hold panel 110 in place relative to rod 105, each stand 115 is shown including a pair of posts 210 that extend from a panel-supporting top surface portion. Posts 210 mate to corresponding associated holes along a center length of panel 110. System 100 thus includes a pair of stands 115 secured atop rod 105 by connectors 205 and each panel 110 is fixed in place by having its center line being laterally supported by the top surface of each stand 115 and held in place by posts 210 extending through complementary mating holes in panel 110. Alternatives to use of posts may include use of an "anti-slip" material for stand 115, or addition of an anti-slip surface treatment (coating, added layer, adhered structure or the like) that provides a sufficiently large static coefficient of friction between the contacting portions of the underside of panel 110 and the top supporting contacting surface of stand 115 to hold panel 110 in place.

Each panel 110 is semi-rigid (flexible to allow the mid-portion to be contour-following and be shaped by the top surface of stand 115, while being stiff enough to "cantilever" out from forward/rearward edges of stand 115 without draping and/or having the lateral edges required to be supported by the protected clothing in order to span a protected volume underlying rod 105). Assuming garments having a representative garment width $W_G$, system 100 spans the protected width $W_P$ having a protected width greater than $W_G$ even without any garments G present. This can be important for several reasons, including populating a closet that does not have any hanging garments on rod 105. When a protection system drapes on the garments or relies heavily on the underlying garments for defining the spanning volume, adding a first garment G requires two hands to lift, shape, and drape the covering.

In FIG. 3, panel 110 is shown in phantom to help better visualize the underlying structure. One thing to note from the illustration in FIG. 3 is that panel 110 is supported from its lateral ends without requiring intermediate and/or continuous longitudinal support (along an axis of rod 105 extending from end to end). This is a function of both the semi-rigid nature of the material(s) used in construction of panels 110 (material composition, thickness, treatments, and the like) and because of the shaped arch imparted to the center of a deployed panel 110 by the top surface of stands 115. Without these characteristics, a mid-portion 305 of the center line, and a mid-portion 310 of the free edges, of panel 110 would sag and be more difficult, it at possible, to allow a user to operate system 100 with a single hand.

In operation (after installation as illustrated and described in FIG. 1-FIG. 3) a user may grasp a garment G hanging from a hanger H as they normally would using a single hand. The user is able to use a portion of the garment/hanger to lift mid-portion 310 to reveal and access rod 105 and allow the user to secure hanger H onto rod 105. Temporarily panel 110 will continue to be supported by the arm of the user as the user withdraws the arm from the protected volume. When withdrawn, panel 110 repeatably returns to the pre-hanging configuration and protects the upper surface(s) of garment G. The user is able to reverse this process to access and remove garment G from within the protected volume by using one hand/arm to lift mid-portion 310, locate garment G, and remove it from rod 105 using that same hand. When garment G is withdrawn, panel 110 repeatably returns to the pre-hanging configuration and protects the upper surface(s) of any other garments.

Panel 110 may be constructed of transparent, translucent, and/or opaque materials for visual and functional (e.g., transparent semi-rigid plastic to better locate a particular desired garment or to review the collection of garments while panel 110 is "down" and spanning the protected width.) Some implementations may employ thin flexible metal panels. However, it is often a case that cost is an important consideration for adoption of a particular solution. System 100 is implemented very simply with a panel, a pair of stands that may be additively manufactured (e.g., 3D printed), and a pair of O-rings/rubber bands. System 100 is easily adjusted for length, by appropriate sizing of a length of the panel(s). System 100 is easily installed as it includes placing a pair stands on top of rod 105 at desired locations, using the connector to secure the stand in place (being elastomeric/rubber itself helps to improve it "grippiness" on rod 105 helping to hold panel in place), and then placing panel 110 into place on top of the stands. The top surfaces of the stands naturally and automatically arch the centerline of each supported panel (from lateral end to lateral end) into its operating profile to cause the lateral edges to be sufficiently supported from the center to define the protected volume.

Figure 4:
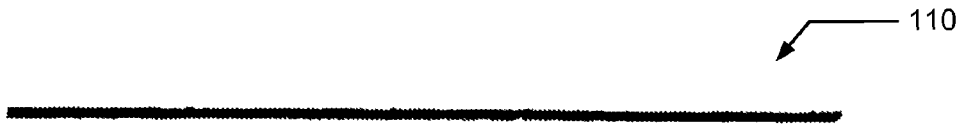
FIG. 4 illustrates a side view of a panel used in the dust protection system of FIG. 1.
Figure 5:
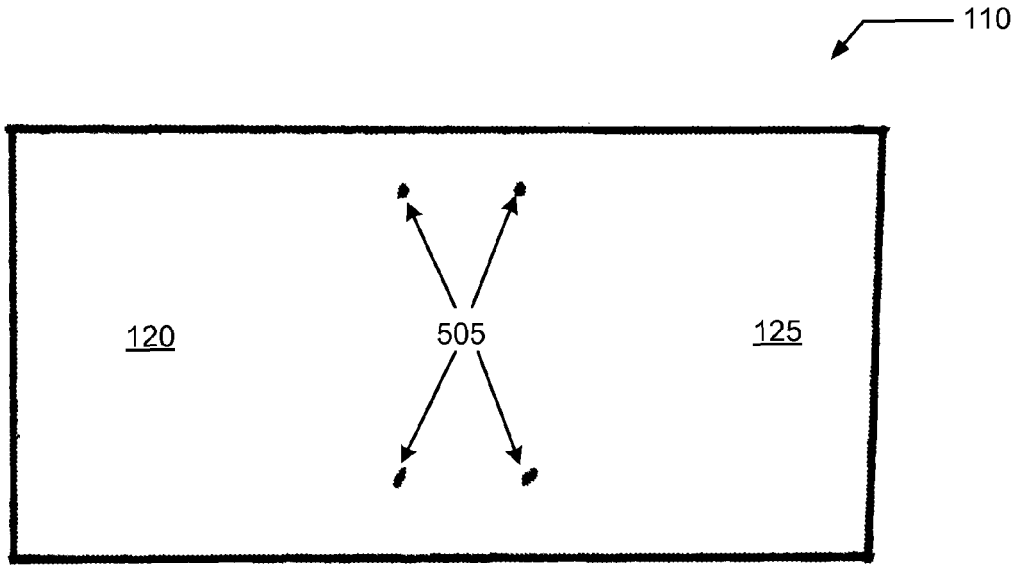
FIG. 5 illustrates a top plan view of the panel.
Figure 6:
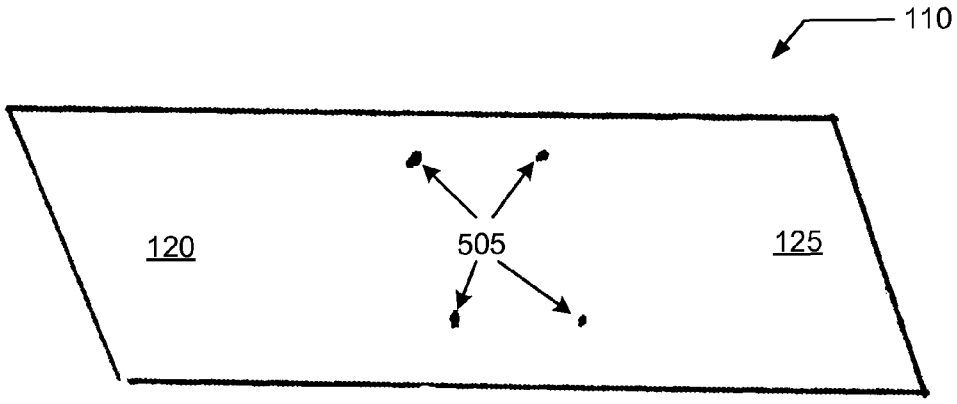
FIG. 6 illustrates a perspective view of the panel.

FIG. 4 illustrates a side view of panel 110; FIG. 5 illustrates a top plan view of panel 110; and FIG. 6 illustrates a perspective view of panel 110. As seen in FIG. 5 and FIG. 6, each panel 110 includes a set of holes 505 evenly spaced from a centerline that correspond to the position of posts 210 when panel 110 is installed. Each holes 505 receive a corresponding associated post 210 (e.g., friction/press fit) that helps secure panel in position.

Figure 7:
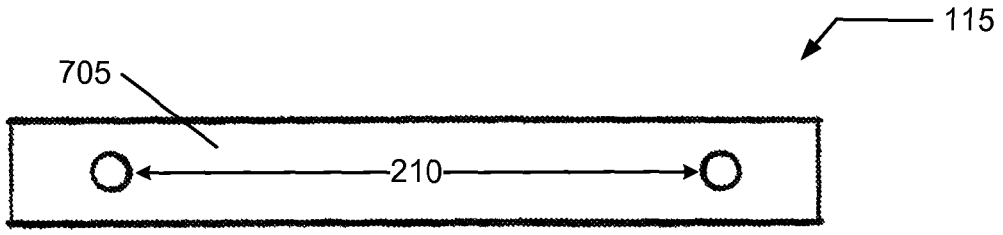
FIG. 7 illustrates a top plan view of a stand used in the dust protection system of FIG. 1.
Figure 8:
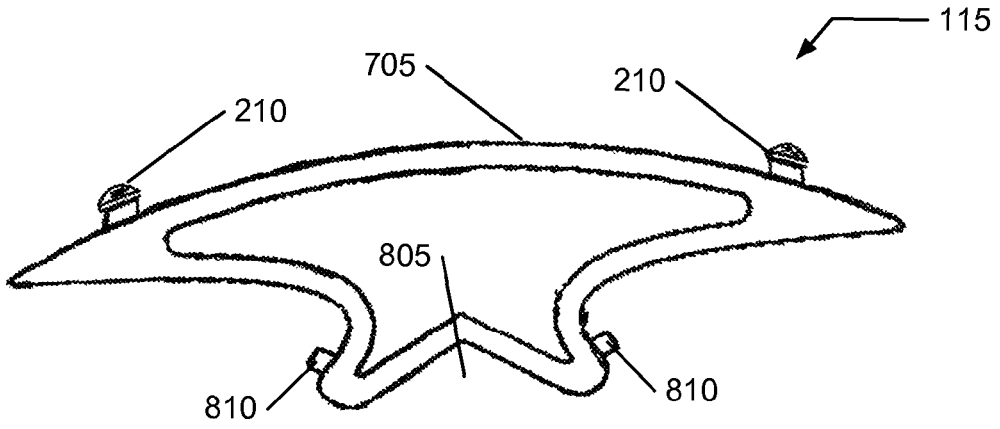
FIG. 8 illustrates a side elevation view of a stand used in the dust protection system of FIG. 1.
Figure 9:
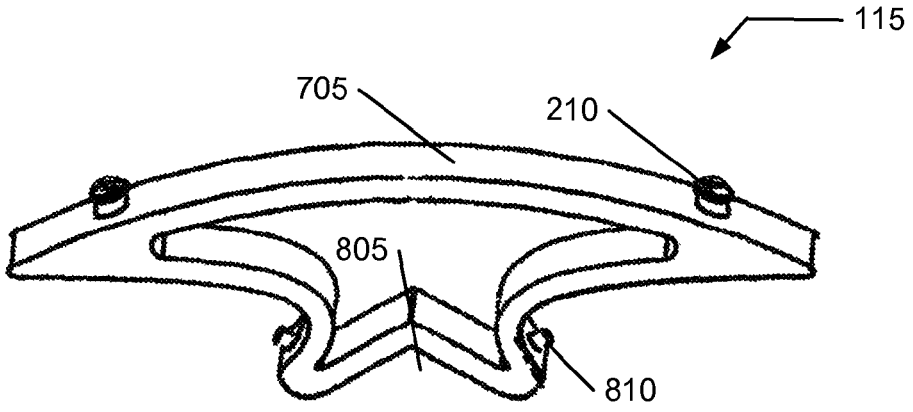
FIG. 9 illustrates a side perspective view of a stand used in the dust protection system of FIG. 1.

FIG. 7 illustrates a top plan view of stand 115; FIG. 8 illustrates a side elevation view of stand 115; and FIG. 9 illustrates a side perspective view of stand 115. Stand 115 includes an arch-defining/imparting top surface 705 that supporting posts 210 near, but spaced apart from, free lateral edges. FIG. 8 illustrates a representative curved arc (which may be a portion of a circumference of a circle or ellipse or other more geometrically complicated shape to properly define and match a shape of panel 110 supported over support surface 705. In some implementations, the top surface may be less optimally implemented as one or a series of linear segments, that define a desired arch in panel 110 (but do not match the resulting arched shape).

Other important features of stand 115 include a rod engaging notch 805 that includes, in the illustrated embodiment, a pair of linear wall segments joined at an angle. That angle and joined wall segments allow stand 115 to operate with a range of diameters for rod 105. As this angle becomes greater, a variation of the diameter of rod 105 does not change a height of surface 705 as much as when the angle is less. The angle of notch 805 may be optimized for standard rod diameters; one factor for implementation of system 100 is that sometimes it is the case that a clearance above a rod 105 until reaching a bottom of a shelf or the ceiling or other overlying surface is limited. System 100, and stand 115 in particular, is designed to work with low clearance distances for a range of different sized rods 105. An angle nominally ninety degrees or greater results may be satisfactory in many implementations, though angles less than, or well in excess of, ninety degrees may work in some situations as noted that the smaller the angle there is increased likelihood of more vertical variation with rod diameter and the greater the angle requires longer connectors/bands and it may become harder to secure stand in place.

As noted earlier, helping to adjust stand 115 to different diameter rods 105, a set of lateral pins 180 are used to engage connector 205 an O-ring/rubber band that extends from one pin 810, around a lower portion of rod 105 not disposed within notch 805 to the other pin 810. System 100 may provide a user with different diameter connectors to allow stand 115 to be properly secured in position.

For installation, a user places stand 115 on rod 105, and then loops connector 205 over one pin 810 and partially wraps connector 205 around an exposed portion of rod 105 to loop connector 205 over the other pin with rod 105 secured inside notch 805. The length and spring constant of connector 205, as well as the configuration of notch 805 and distance separating pins 810 determines how much connector 205 is stretched to impart the holding force to rod 105. A different diameter of connector 205 and/or construction material allows a user/manufacturer to set a desired holding force for stand 115 relative to rod 105.

In one embodiment, panel 110 is of lightweight, slightly flexible sheet material, such as plastic or metal. Panel 110 rests on (or otherwise secured or affixed thereto) two or more stands 115 distributed over a length of rod 105 in such a way as to provide strength through creation of a curved segment of its mid portion. Each hanging free edge may be optionally curved for increased stability; however the systems illustrated herein do not include this feature. Panel 110 is fixed to stands 115 by fitting over posts disposed on a panel-resting surface of each stand 115, which may be a friction or press fit. Stands 115 may be implemented as disclosed herein with each being identical, each stand 115 designed to support and shape an underside of a mid-portion of a portion of a panel, while rising above closet rod 105, fixed by elastic straps. A curvature of the panel-supporting surface and height of the stands is designed to create stability, while allowing sufficient room to remove and replace hangers. Panel 110 is fixed to stands 115 by fitting over posts on the front and rear of the top surface of each stand 115. Stands 115 are fixed to closet rod 105 by elastic straps.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A garment protection system operational with a horizontally disposed clothes rod, comprising:

a pair of stands, each stand including an arched surface portion coupled to a notch portion, said arched surface portion having a curve profile and said notch portion including a pair wall segments joined together defining an angle with said curve profile substantially symmetric about an axis bisecting said angle; and a semi-rigid panel configured to both substantially match said curve profile along a panel length from a first end to a second end when a panel center portion is laterally supported by said arched surface portions at said ends and to non-drapingly support lateral edges of said panel to define a span from one lateral edge to an opposing lateral edge with the rod disposed in between said lateral edges wherein each said surface portion includes a pair of posts each having a post diameter and wherein said panel includes four complementary holes configured to receive said posts.

2. A garment protection system operational with a horizontally disposed clothes rod, comprising:

a pair of stands, each stand including an arched surface portion coupled to a notch portion, said arched surface portion having a curve profile and said notch portion including a pair wall segments joined together defining an angle with said curve profile substantially symmetric about an axis bisecting said angle; and a semi-rigid panel configured to both substantially match said curve profile along a panel length from a first end to a second end when a panel center portion is laterally supported by said arched surface portions at said ends and to non-drapingly support lateral edges of said panel to define a span from one lateral edge to an opposing lateral edge with the rod disposed in between said lateral edges;

wherein said stand has a stand width between a first edge of said arched support portion and said axis wherein said span is at least twice as large as said stand width; and wherein each said surface portion includes a pair of posts each having a post diameter and wherein said panel includes four complementary holes configured to receive said posts.

3. A garment protection system operational with a horizontally disposed clothes rod, comprising:

a pair of stands, each stand including an arched surface portion coupled to a notch portion, said arched surface portion having a curve profile and said notch portion including a pair wall segments joined together defining an angle with said curve profile substantially symmetric about an axis bisecting said angle; and a semi-rigid panel configured to both substantially match said curve profile along a panel length from a first end to a second end when a panel center portion is laterally supported by said arched surface portions at said ends and to non-drapingly support lateral edges of said panel to define a span from one lateral edge to an opposing lateral edge with the rod disposed in between said lateral edges further comprising a pair of pins disposed on an exterior surface of said stand proximate to but outside said notch portion, said pins located substantially symmetrically relative to said axis.

4. The system of claim 2 further comprising a pair of pins disposed on an exterior surface of said stand proximate to but outside said notch portion, said pins located substantially symmetrically relative to said axis.

* * * * *